US006186491B1

(12) United States Patent
Tomiyama et al.

(10) Patent No.: US 6,186,491 B1
(45) Date of Patent: Feb. 13, 2001

(54) SHEET FEEDING APPARATUS

(75) Inventors: Katsuya Tomiyama; Isamu Nakabayashi, both of Tokyo (JP)

(73) Assignee: NEC Corporation, Tokyo (JP)

( * ) Notice: Under 35 U.S.C. 154(b), the term of this patent shall be extended for 0 days.

(21) Appl. No.: 09/280,828

(22) Filed: Mar. 30, 1999

(30) Foreign Application Priority Data

Oct. 2, 1998 (JP) ..... 10-281372

(51) Int. Cl.[7] ..... B65H 5/12

(52) U.S. Cl. ..... 271/12; 271/10.03; 271/10.05; 271/94; 271/96; 271/31.1

(58) Field of Search ..... 271/10.03, 10.05, 271/10.07, 94, 96, 30.1, 31, 31.1, 11, 12

(56) References Cited

U.S. PATENT DOCUMENTS

| | | | | |
|---|---|---|---|---|
| 3,504,909 | * | 4/1970 | Burkhardt | 271/96 |
| 3,599,967 | * | 8/1971 | Rapparlie et al. | 271/94 |
| 4,018,434 | | 4/1977 | Mitchell et al. | 271/96 |
| 4,030,723 | | 6/1977 | Irvine et al. | 271/11 |
| 5,090,676 | * | 2/1992 | Matsuno et al. | 271/94 |
| 5,391,051 | | 2/1995 | Sabatier et al. | 414/797 |

FOREIGN PATENT DOCUMENTS

| | | | | |
|---|---|---|---|---|
| 0 333 171 | | 3/1989 | (EP) . | |
| 000507661A1 | * | 10/1992 | (EP) | 271/94 |
| 51-43195 | | 9/1974 | (JP) . | |
| 61-160121 | | 10/1986 | (JP) . | |
| 64-7138 | | 1/1989 | (JP) . | |
| 1-187137 | * | 7/1989 | (JP) | 271/96 |
| 3-166159 | | 7/1991 | (JP) . | |
| 6-71227 | | 3/1994 | (JP) . | |
| 6-28504 | | 8/1994 | (JP) . | |
| 8-12109 | | 1/1996 | (JP) . | |

OTHER PUBLICATIONS

Patent Abstracts of japan, vol. 18, No. 322 (C–1214), Jun. 20, 1994.

* cited by examiner

*Primary Examiner*—H. Grant Skaggs
(74) *Attorney, Agent, or Firm*—Sughrue, Mion, Zinn, Macpeak & Seas, PLLC

(57) ABSTRACT

A sheet feeding apparatus includes a carrier portion, a suction belt, a servo motor, a blower, a solenoid valve, a pressure sensor, a position sensor, a belt hole sensor, and a controller. The carrier portion feeds a plurality of sheets of different sizes in a direction of their thickness in an upright state. The suction belt has a belt hole for drawing each sheet fed from the carrier portion by suction, so as to feed out each sheet drawn by suction with the belt hole. The servo motor drives the suction belt. The blower generates a pressure for drawing the sheet by suction in the belt hole. The solenoid valve enables/disconnects supply of the negative pressure from the blower to the belt hole. The pressure sensor measures a pressure in the belt hole. The position sensor detects the sheet fed out by the suction belt. The belt hole sensor detects the belt hole after the sheet is fed out. The controller controls operations of the solenoid valve and the servo motor on the basis of detection outputs from the pressure sensor, the position sensor, and the belt hole sensor.

17 Claims, 4 Drawing Sheets

SHEET FEEDING APPARATUS

BACKGROUND OF THE INVENTION

The present invention relates to a sheet feeding apparatus and, more particularly, to a sheet feeding apparatus for feeding out mail items having different sizes, weights, and shapes one by one.

As an example of a conventional sheet feeding apparatus, a sheet extracting apparatus described in Japanese Patent Laid-Open No. 6-71227 (Reference 1) is known.

Reference 1 describes a technique for extracting sheets by utilizing the negative pressure of a negative pressure chamber. Reference 1 also describes a technique for measuring the pressure in the negative pressure chamber with a pressure sensor and informing an abnormality when the value of the pressure sensor becomes less than a predetermined value, and a technique for blocking the flow of air to the negative pressure chamber with a relief valve connected to the negative pressure chamber, when no mail exists, to decrease noise.

FIG. 4 shows the schematic arrangement of the conventional sheet extracting apparatus described in Reference 1. The sheet extracting apparatus shown in FIG. 4 comprises a suction belt 60 for supplying a mail item 58, a negative pressure chamber 62 close to the suction belt 60 to receive a negative pressure, an air pipe 64 connected to the negative pressure chamber 62, a relief valve 66 for controlling the negative pressure of the negative pressure chamber 62, an air filter 68 for removing dust and the like in the air, and a blower 70 for generating a negative pressure.

A pressure sensor 72 for detecting the pressure is placed in the negative pressure chamber 62, and a mail sensor 74 for detecting the presence/absence of a mail item is placed at a position where the mail item 58 is placed. Outputs from the sensors 72 and 74 are input to a CPU (Central Processing Unit) 76 having an air pressure determining section 76a. The CPU 76 is connected to a valve controller 78 for controlling the relief valve 66, and a display 82 and a voice guide 84 that constitute an informing unit 80 for informing the operator of the state of the apparatus.

The operation of the sheet extracting apparatus having the above arrangement will be described.

Usually, the mail items 58 are drawn by the suction belt 60 with the negative pressure of the negative pressure chamber 62 one by one, and each mail item is fed by the suction belt 60 in the convey direction. With a lapse of a predetermined period of time since the start of operation of the apparatus, if the mail sensor 74 determines that no mail item 58 has been fed to the suction belt 60 for a predetermined period of time or more, the CPU 76 controls the valve controller 78 to diagnose the apparatus by utilizing the idling time during which no mail item is fed. Thus, the relief valve 66 is closed to set the interior of the negative pressure chamber 62 at a negative pressure.

The state in the negative pressure chamber 62 is detected by the pressure sensor 72. The CPU 76 compares the detected pressure and a normal-state pressure with the air pressure determining section 76*a*. The CPU 76 determines whether the comparison result is less than a predetermined value. If the comparison result is less than a predetermined value, the CPU 76 drives the display 82 and voice guide 84 of the informing unit 80 to inform the operator of an abnormality.

From the detection result of the mail sensor 74, if no mail item 58 is placed in front of the suction belt 60, the relief valve 66 is switched to an open state to release the pressure, so the interior of the negative pressure chamber 62 does not become a negative pressure. This aims at preventing the interior of the negative pressure chamber 62 from becoming a negative pressure to generate air suction noise.

In the conventional sheet extracting apparatus described above, when sheets such as mail items having largely different sizes, weights, and shapes are to be extracted by suction one by one, sometimes a particularly heavy mail item is not reliably drawn by suction with the rotating suction belt 60. In this case, the suction belt 60 performs idling and does not feed a mail item, or a mail item is conveyed while slipping on the suction belt 60. Then, an interval cannot be maintained between the currently fed mail item and a mail item which is to be extracted next.

This is because, when feeding the mail, the suction belt 60 is continuously rotated at a constant speed without stopping. Another reason is as follows. The pressure in the negative pressure chamber 62 is measured by the pressure sensor 72. If the measurement result is less than a predetermined value, it is utilized for only informing the operator of the abnormality of the suction portion including the negative pressure chamber.

In the conventional sheet extracting apparatus described above, when one mail item is extracted and thereafter the next mail item is to be extracted, the next mail item is sometimes fed at an earlier timing than usual. In this case, the next mail item overlaps the current one to be conveyed together with it.

This is due to the following reason. Since the relief valve 66 is not turned on/off every time one mail item is fed, the interior of the negative pressure chamber 62 is always at a negative pressure, and accordingly a force for drawing the mail item by suction is always effected.

SUMMARY OF THE INVENTION

It is an object of the present invention to provide a sheet feeding apparatus in which, when feeding sheets having largely different sizes, weights, and shapes, the sheets can be drawn with a suction belt reliably, and can be stably fed one by one.

It is another object of the present invention to provide a sheet feeding apparatus in which a sheet is prevented from being fed at an earlier timing than usual, thereby preventing double feeding.

In order to achieve the above objects, according to the present invention, there is provided a sheet feeding apparatus comprising a sheet feed portion for feeding a plurality of sheets of different sizes in a direction of thickness thereof in an upright state, a suction belt having a belt hole for drawing each sheet fed from each sheet feed portion by suction, so as to feed out the sheet drawn by suction with the belt hole, drive means for driving the suction belt, negative pressure generating means for generating a pressure for drawing the sheet by suction in the belt hole, opening/closing means for applying/stopping applying the negative pressure from the negative pressure generating means to the belt hole, a pressure sensor for measuring a pressure in the belt hole, a first detection sensor for detecting the sheet fed out by the suction belt, a second detection sensor for detecting the belt hole after the sheet is fed out, and control means for controlling operations of the opening/closing means and the drive means on the basis of detection outputs from the pressure sensor and the first and second detection sensors.

DESCRIPTION OF THE PREFERRED EMBODIMENT

The preferred embodiment of the present invention will be described with reference to the accompanying drawings.

Figure 1:
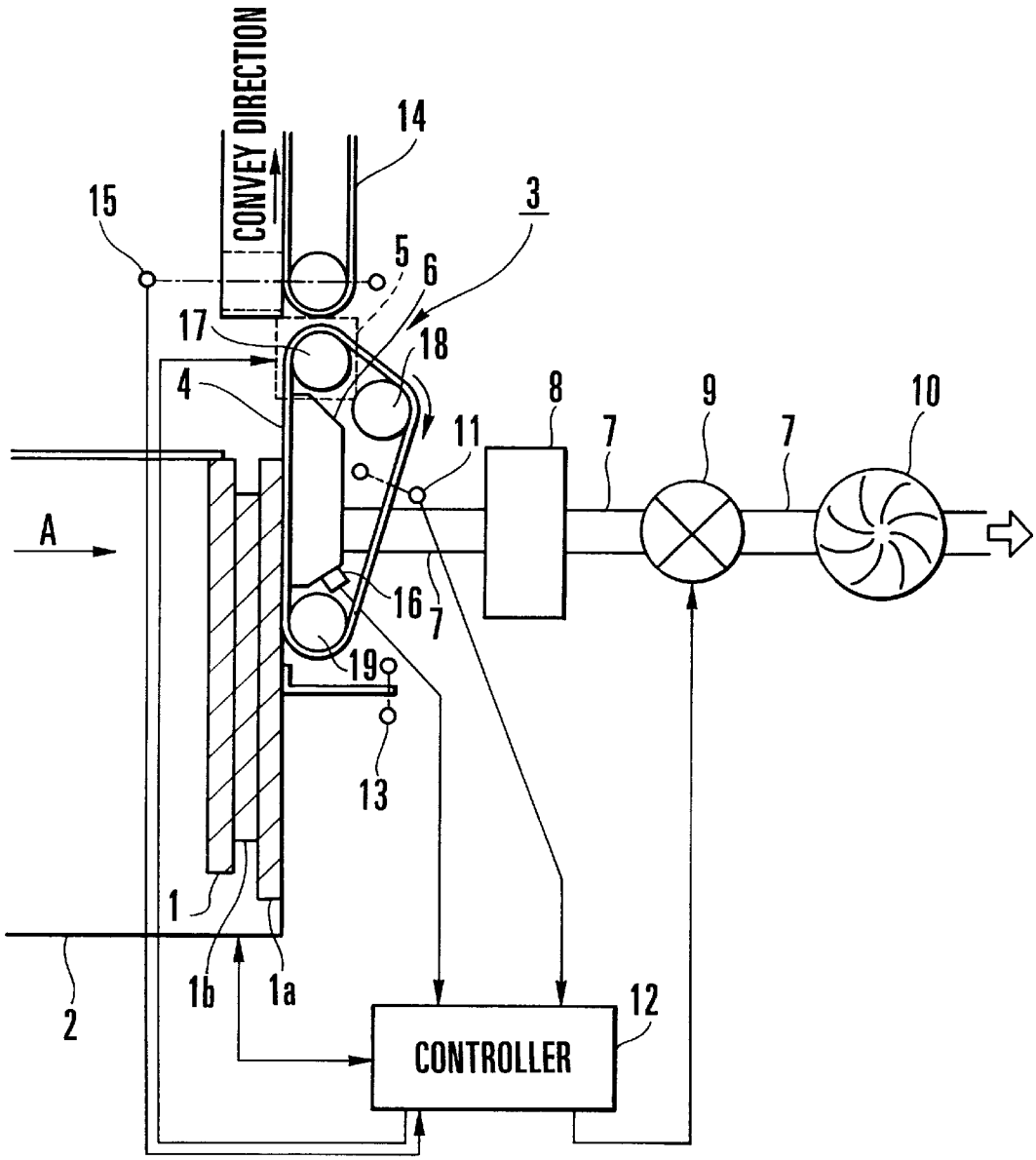
FIG. 1 is a view showing the schematic arrangement of a sheet feeding apparatus according to an embodiment of the present invention.

FIG. 1 shows a sheet feeding apparatus according to an embodiment of the present invention.

Referring to FIG. 1, sheets 1 are placed on a carrier portion 2 in an upright state. The carrier portion 2 serves as a sheet feed portion to push the sheets 1 in a direction of their thickness with a pushing means (not shown), thereby feeding them to a sheet extracting portion 3. A sheet sensor 13 for detecting the presence/absence of the sheet is arranged near the sheet extracting portion 3 to be flush with it. The sheet extracting portion 3 sequentially feeds an uppermost sheet la detected by the sheet sensor 13.

The sheet extracting portion 3 is constituted by a wide, endless suction belt 4, a servo motor 5, a negative pressure chamber 6, a belt hole sensor 11, and a pressure sensor 16. The suction belt 4 is formed with a plurality of rows of a plurality of belt holes 4*a* (FIG. 2) at a predetermined pitch in the longitudinal direction. The servo motor 5 drives the suction belt 4 through a drive roller 17. The negative pressure chamber 6 draws the sheet 1 by suction through the belt holes 4*a* of the suction belt 4. The belt hole sensor 11 detects the positions of the belt holes 4*a* in order to stop them at predetermined positions. The pressure sensor 16 detects the pressure in the negative pressure chamber 6.

In this embodiment, the two pairs of belt holes 4*a* formed in the widthwise direction of the suction belt 4 are arranged equidistantly in the longitudinal direction of the suction belt 4. Hence, when the belt holes 4*a* of one pair are detected and the suction belt 4 is stopped, the belt holes 4*a* of the other pair are stopped at the suction position of the sheet 1. The suction belt 4 is kept taut between driven rollers 18 and 19.

A blower 10 is connected to the negative pressure chamber 6 through an air hose 7 to generate a negative pressure in it. An air filter 8 is connected between the negative pressure chamber 6 and blower 10 to remove dust in air drawn by the negative pressure chamber 6. A solenoid valve 9 is connected between the air filter 8 and blower 10 to control the negative pressure in the negative pressure chamber 6.

Signals from the belt hole sensor 11, a position sensor 15, and pressure sensor 16 are output to a controller 12. The controller 12 controls the servo motor 5 and solenoid valve 9 on the basis of these sensor outputs.

A convey unit 14 for conveying the sheet 1 by supporting its bottom and side surfaces is arranged on a downstream side, in the convey direction, of the sheet extracting portion 3. The convey unit 14 conveys each separated sheet downstream. The position sensor 15 for detecting the leading end of the sheet 1 is arranged at the inlet of the convey unit 14.

Figure 2:
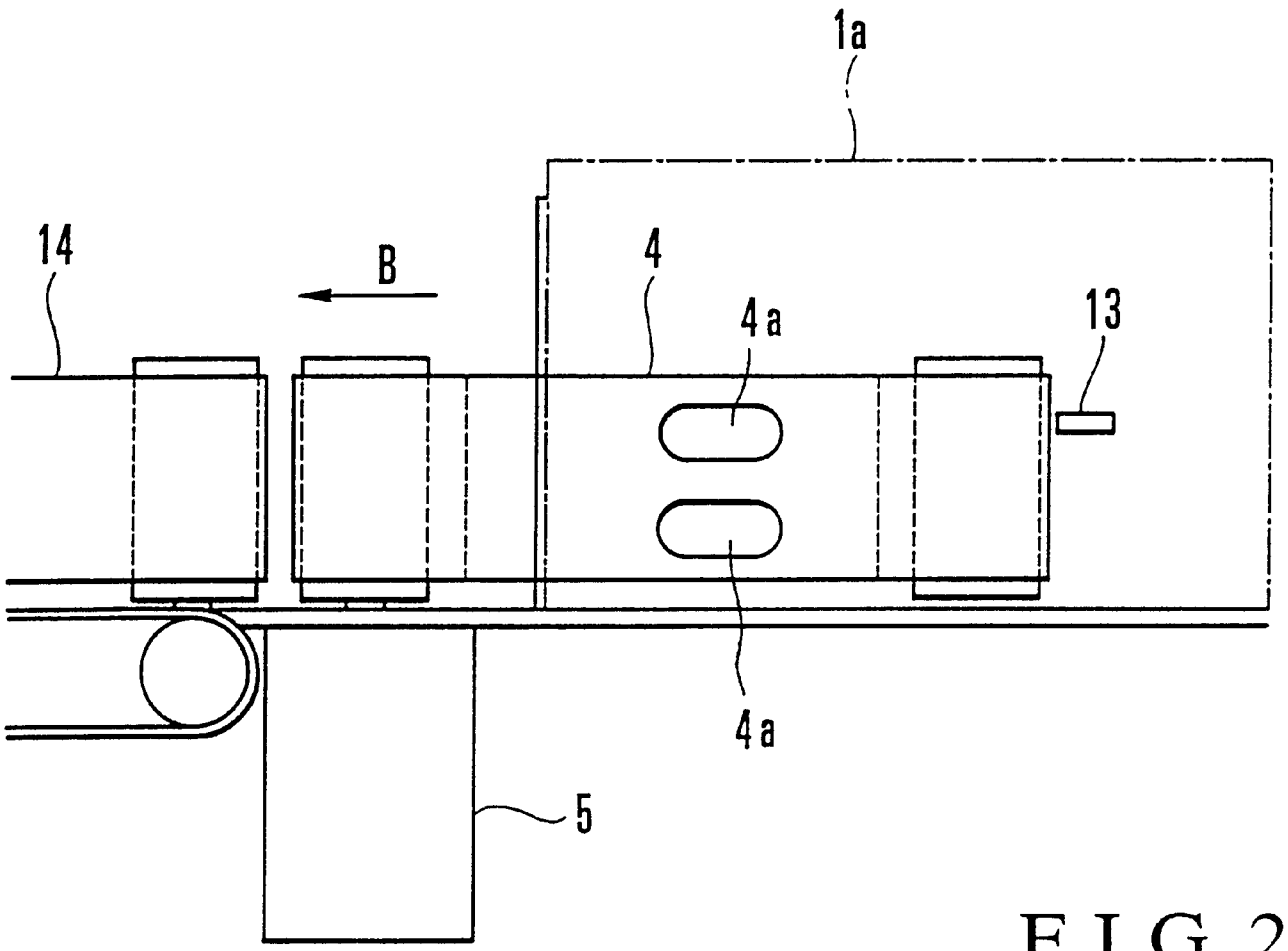
FIG. 2 is an enlarged view of the main part of the sheet feeding apparatus of FIG. 1 seen from a direction A.

The operation of the sheet feeding apparatus having the above arrangement will be described with reference to FIGS. 2 and 3. FIG. 2 shows the main part of the apparatus in enlargement from the direction of arrow A in FIG. 1. FIGS. 3A to 3E are timing charts showing the sheet extracting operation.

The sheet 1 placed on the conveyor portion 2 is fed toward the sheet extracting portion 3. When the sheet 1 is detected by the sheet sensor 13, the pushing operation is stopped. At this time, the belt holes 4*a* of the suction belt 4 are stopped at the positions shown in FIG. 2. Since the solenoid valve 9 is ON to generate a negative pressure in the negative pressure chamber 6, the uppermost sheet la is drawn by suction with the suction belt 4. When the sheet la is drawn by suction and the pressure in the negative pressure chamber 6 becomes a predetermined value or more, an ON signal is output from the pressure sensor 16 to enable the feedout operation of the sheet.

This state corresponds to time t0 of FIGS. 3A to 3E, where the solenoid valve 9 is ON (FIG. 3D), the output from the pressure sensor 16 is ON (FIG. 3C), and the sheet 1*a* is drawn by suction with the suction belt 4.

Figures 3A, 3B, 3C, 3D, 3E:
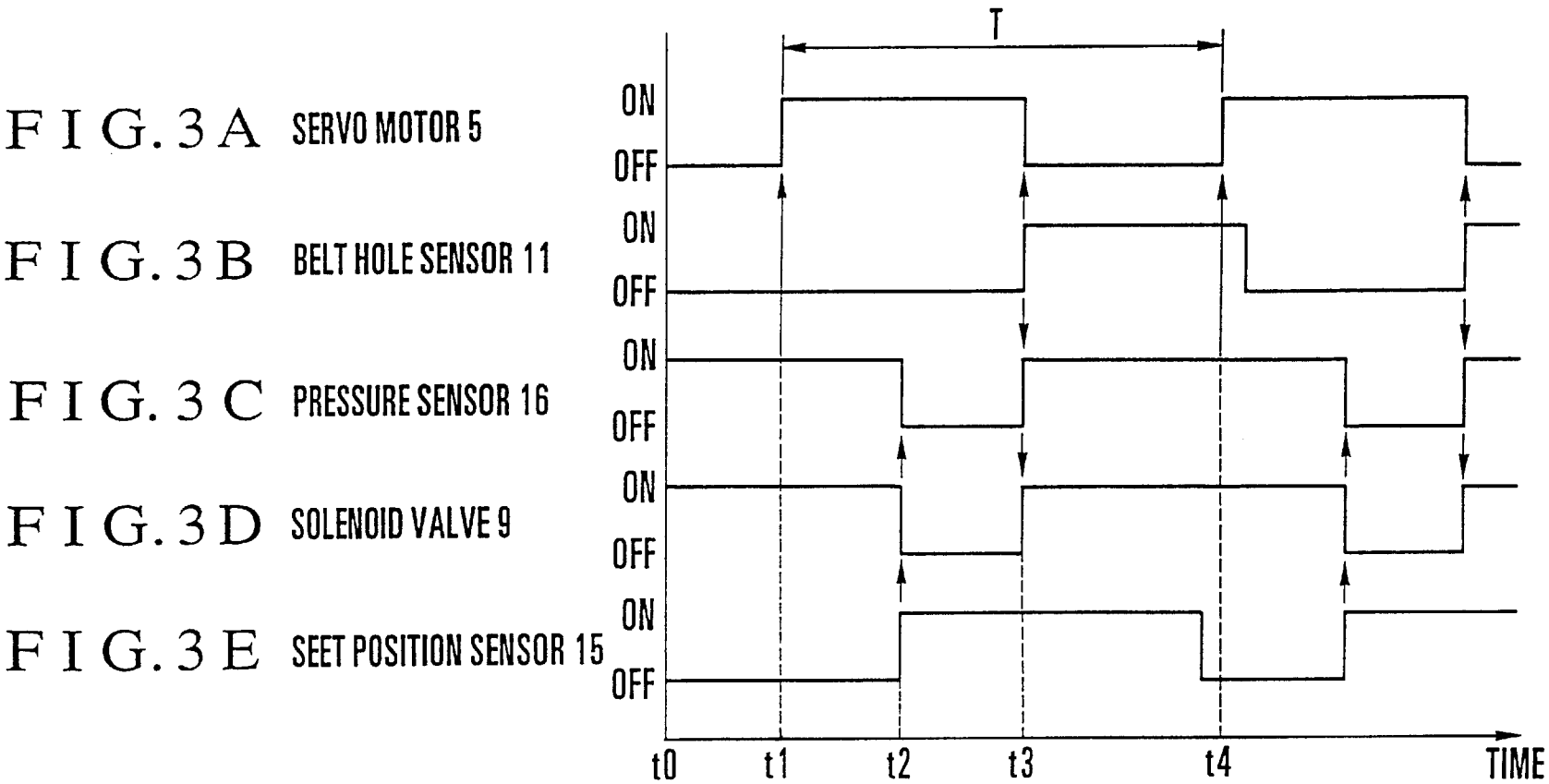
FIGS. 3A to 3E are timing charts indicting the sheet extracting operation of the sheet feeding apparatus of FIG. 1.
Figure 4:
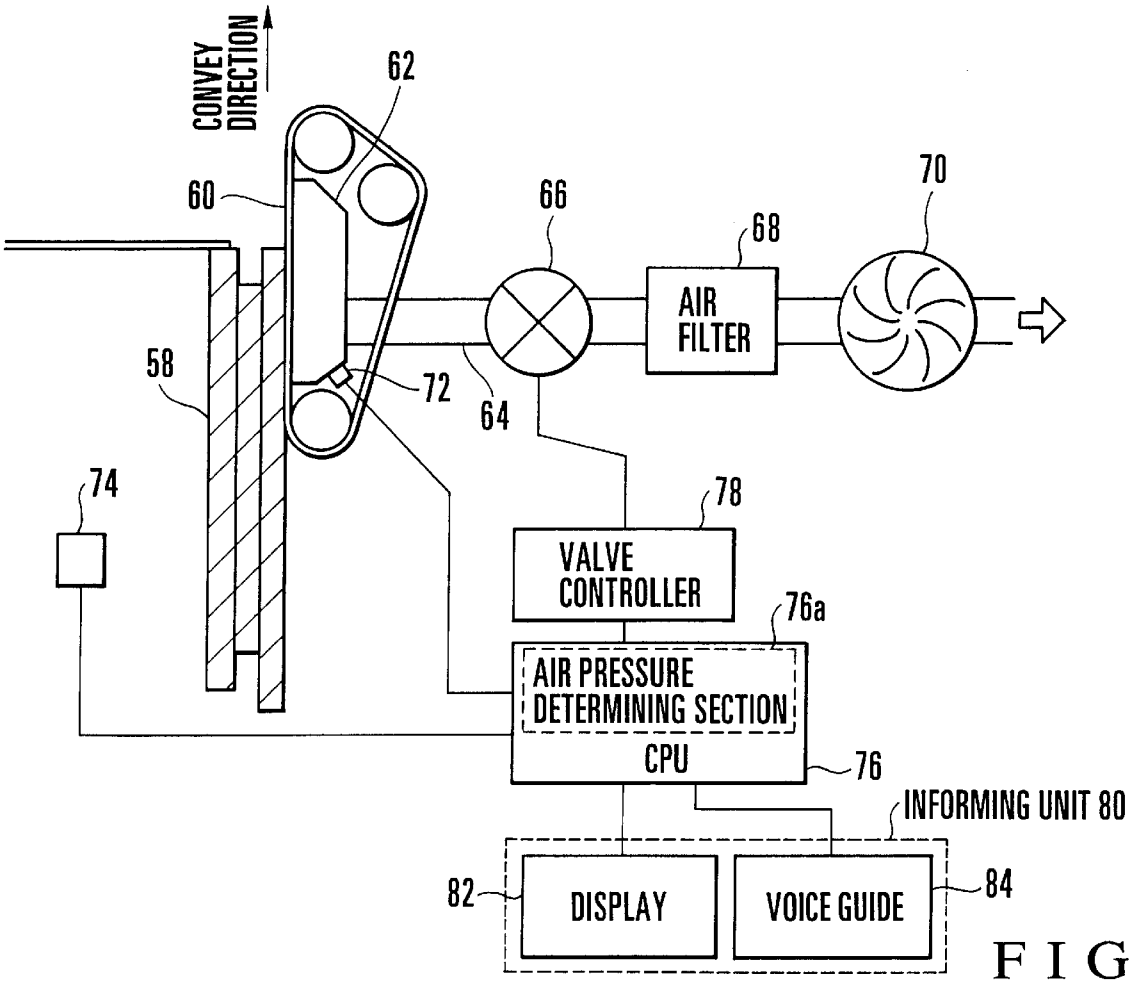
FIG. 4 PRIOR ART
FIG. 4 is a view showing the schematic arrangement of a conventional sheet extracting apparatus.

After that, at time t1, the controller 12 turns on the servo motor 5 to drive the suction belt 4 (FIG. 3A). Thus, the feedout operation of the sheet 1*a* drawn by suction with the suction belt 4 toward the convey unit 14 is started.

When the feed operation of the sheet 1 by the carrier portion 2 is delayed, the sheet 1*a* is not sufficiently drawn by suction with the suction belt 4, and the pressure in the negative pressure chamber 6 becomes lower than the predetermined value. The pressure sensor 16 does not output an ON signal, and even at time t1, the servo motor 5 is not turned on, so the feedout operation of the sheet 1*a* is not started. After the sheet 1*a* is sufficiently drawn by suction with the suction belt 4, the pressure in the negative pressure chamber 6 becomes the predetermined value or more, and the pressure sensor 16 outputs an ON signal, then the servo motor 5 is turned on to start the feedout operation of the sheet 1*a*.

After the feedout operation of the sheet 1*a* is started, at time t2, the position sensor 15 detects that the leading end of the sheet 1*a* has reached the convey unit 14 (FIG. 3E). When the position sensor 15 outputs a detection signal, the controller 12 turns off the solenoid valve 9 (FIG. 3D). The interior of the negative pressure chamber 6 is restored to the atmospheric pressure, and the sheet 1*a* released from the suction belt 4 is transferred to the convey unit 14 and is conveyed by it.

After the sheet 1*a* is fed out, at time t3, the belt hole sensor 11 detects the belt holes 4*a* of the suction belt 4 (FIG. 3B). When the belt hole sensor 11 outputs a detection signal, the controller 12 stops driving the suction belt 4 (FIG. 3A). The belt holes 4*a* of the other pair are thus stopped at positions where they are in contact with the sheet 1 shown in FIG. 2. Simultaneously, the controller 12 turns on the solenoid valve 9 (FIG. 3D), and a next sheet 1*b* fed by the carrier portion 2 is drawn by suction with the suction belt 4.

After that, at time t4 at a lapse of a time T (sec) since the servo motor 5 is turned on, the controller 12 checks whether the pressure sensor 16 outputs an ON signal. If YES, the controller 12 determines that the next sheet 1*b* is drawn by suction with the suction belt 4, and turns on the servo motor 5 again. Therefore, the suction belt 4 is driven to start the feedout operation of the next sheet 1*b*. In this manner, the sheets are sequentially fed out at an interval of time T (sec).

The minimum period T of the ON/OFF timing of the servo motor 5 can be set before starting the apparatus. Accordingly, the value of the period T can be changed.

In the above embodiment, the belt holes 4*a* are arranged in two pairs in the longitudinal direction of the suction belt 4. However, if the belt holes 4*a* can be stopped at positions where they are in contact with the sheet 1, they may be arranged in one pair, three pairs, or more. When one pair of belt holes 4*a* are provided, they can be stopped at positions where they are in contact with the sheet 1, by feeding the suction belt 4 by a predetermined amount after they are detected. It suffices if at least one or more belt holes 4*a* are formed in the widthwise direction of the suction belt 4.

As has been described above, according to the present invention, when the sheet is fed, the suction belt is stopped temporarily, so that the sheet can be reliably drawn by suction with the suction belt. At the start of the feed operation of the sheet, if the value of the pressure sensor that detects the pressure in the negative pressure chamber is less than a predetermined value, the suction belt is not rotated. The suction belt is rotated when the value of the pressure sensor reaches a predetermined value or more. Therefore, slipping between the suction belt and the sheet, which occurs when suction is insufficient, is decreased, and a short sheet-feed interval or double feeding can be prevented.

After it is detected that each sheet which is fed one by one is transferred to the downstream convey unit and before the suction belt is temporarily stopped to draw the next sheet by suction, the solenoid valve is turned off to restore the interior of the negative pressure chamber to the atmospheric pressure. This prevents the next sheet from being fed at an earlier timing than usual, thus preventing a short feed interval or double feeding.

What is claimed is:

1. A sheet feeding apparatus comprising:

a sheet feed portion for feeding a plurality of sheets of different sizes in a direction of thickness thereof in an upright state;

a suction belt having a belt hole for drawing each sheet fed from said sheet feed portion by suction, so as to feed out each sheet drawn by suction with the belt hole;

drive means for driving said suction belt;

negative pressure generating means for generating a pressure for drawing the sheet by suction in the belt hole;

a valve for selectively applying the negative pressure from said negative pressure generating means to the belt hole;

a pressure sensor for measuring a pressure in the belt hole;

a first detection sensor for detecting the sheet fed out by said suction belt;

a second detection sensor for detecting the belt hole after the sheet is fed out; and control means for controlling operations of said valve and said drive means on the basis of detection outputs from said pressure sensor and said first and second detection sensors.

2. An apparatus according to claim 1, wherein said control means sets the pressure in the belt hole to a negative pressure while said suction belt is stopped, to draw by suction the sheet fed from said sheet feed portion and, when the negative pressure in the belt hole detected by said pressure sensor, after the sheet is drawn by suction, is not less than a predetermined value, starts to drive said suction belt.

3. An apparatus according to claim 2 wherein, when the negative pressure in the belt hole detected by said pressure sensor after the sheet is drawn by suction is less than the predetermined value, said control means does not drive said suction belt so that said suction belt is a stopped state.

4. An apparatus according to claim 1 wherein, when the sheet fed out by said suction belt is detected by said first detection sensor, said control means closes said value means to restore the pressure in the belt hole to an atmospheric pressure.

5. An apparatus according to claim 1 wherein, when the belt hole is detected by said second detection sensor while said suction belt is driven, said control means stops said suction belt at a position where the belt hole is capable of contact with a next sheet, and opens said valve while said suction belt is stopped, to generate a negative pressure in the belt hole, thereby drawing the next sheet by suction with said suction belt.

6. An sheet feeding apparatus comprising:

a sheet feed portion for feeding a plurality of sheets of different sizes in a direction of thickness thereof in an upright state;

a suction belt having a belt hole for drawing each sheet fed from said sheet feed portion by suction, so as to feed out each sheet drawn by suction with the belt hole;

drive means for driving said suction belt;

negative pressure generating means for generating a pressure for drawing the sheet by suction in the belt hole;

a valve for selectively applying the negative pressure from said negative pressure venerating means to the belt hole;

a pressure sensor for measuring a pressure in the belt hole;

a first detection sensor for detecting the sheet fed out by said suction belt;

a second detection sensor for detecting the belt hole after the sheet is fed out; and control means for controlling operations of said valve and said drive means on the basis of detection outputs from said pressure sensor and said first and second detection sensors, wherein, after a predeternmined period T—between times at which said suction belt is started to drive—elapses, when the negative pressure in the belt hole detected by said pressure sensor is not less than a predetermined valve, said control means again starts to drive said suction belt.

7. An apparatus according to claim 6, wherein said control means controls said suction belt at a stop state when the negative pressure in the belt hole detected by said pressure sensor is less than the predetermined value, and starts to drive said suction belt when the negative pressure in the belt hole detected by said pressure sensor is not less than the predetermined value.

8. An apparatus according to claim 6, wherein the predeternmined period T, between times at which said suction belt is started to drive, can be changed.

9. An apparatus according to claim 1, wherein the belt hole comprises a plurality of belt holes formed at a predetermined interval in a longitudinal direction of said suction belt, and when one of the belt holes is detected by said second detection sensor, another one of the belt holes is stopped at a sheet suction position.

10. An apparatus according to claim 1, wherein said apparatus further comprises a convey unit arranged on a downstream side, in a convey direction, of said suction belt to constantly convey a fed sheet in the convey direction, and said first detection sensor is arranged at an inlet of said convey unit.

11. An apparatus according to claim 1, wherein said apparatus further comprises a negative pressure chamber provided inside said suction belt to communicate with the belt hole, and said pressure sensor measures the pressure in said negative pressure chamber.

12. An apparatus according to claim 11, wherein said suction belt, said drive means, said pressure sensor, said second detection sensor, and said negative pressure sensor constitute a sheet extracting portion.

13. An apparatus according to claim 1, wherein said drive means comprises a servo motor, said negative pressure generating means comprises a blower, and said value means comprises a solenoid valve arranged in an air path between said blower and the belt hole.

14. A sheet feeding apparatus comprising:

a sheet feed portion which feeds a plurality of sheets of different sizes in a direction of thickness thereof in an upright state;

a suction belt having a belt hole for drawing each sheet fed from said sheet feed portion by suction, so as to feed out each sheet drawn by suction with the belt hole;

drive motor for driving said suction belt;

a blower, in communication with said suction belt, which creates a pressure tending to draw the sheet by suction to the belt hole;

a valve which selectively applies the negative pressure from said blower to the belt hole;

a pressure sensor which measures a pressure in the belt hole;

a first detection sensor which detects a leading end of the sheet fed out by said suction belt;

a second detection sensor which detects the belt hole after the sheet is fed out; and control circuit which controls operations of said valve and said drive motor on the basis of detection outputs from said pressure sensor and said first and second detection sensors, so that after a predetermined period T—between times at which said suction belt is started to drive—elapses, when the negative pressure in the belt hole detected by said pressure sensor is not less than a predetermined value, said control circuit again starts to drive said suction belt.

15. A sheet feeding apparatus comprising:

a sheet feed portion for feeding a plurality of sheets of different sizes in a direction of thickness thereof in an upright state;

a suction belt having a first hole and a second hole for drawing each sheet fed from said sheet feed portion by suction, so as to feed out each sheet drawn by suction with one of said first and second holes;

a drive motor that drives said suction belt;

a blower that generates a pressure for drawing the sheet by suction in one of said first and second holes;

a valve for selectively applying the negative pressure from said blower to one of said first and second holes that is temporarily in communication with said blower;

a pressure sensor for measuring a pressure in said first or second hole that is temporarily in communication with said blower;

a first detection sensor for detecting the sheet fed out by said suction belt;

a second detection sensor for detecting, after the sheet is fed out, said first or second hole that was temporarily in communication with said blower; and a control circuit that controls operations of said valve and said drive motor on the basis of detection outputs from said pressure sensor and said first and second detection sensors; and wherein said first and second holes are spaced apart from each other at a predetermined interval on said belt so that only one of said first and second holes communicates with said blower at any one time.

16. The apparatus according to claim 15, wherein each of said first and second holes includes a set of closely spaced holes.

17. The apparatus according to claim 15, wherein said control circuit closes said valve to eliminate said negative pressure after said first detection sensor detects a sheet fed out by said suction belt and before said suction belt is temporarily stopped.

* * * * *